US005450989A

United States Patent [19]

Gilroy

[11] Patent Number: 5,450,989

[45] Date of Patent: Sep. 19, 1995

[54] AEROSOL VALVE

[75] Inventor: Gordon C. Gilroy, Bedford, N.H.

[73] Assignee: Summit Packaging Systems, Inc., Manchester, N.H.

[21] Appl. No.: 297,500

[22] Filed: Aug. 29, 1994

[51] Int. Cl.[6] ..... B65D 83/16

[52] U.S. Cl. ..... 222/402.24; 222/402.1

[58] Field of Search ..... 222/402.1, 402.21, 402.22, 222/402.23, 402.24, 402.25

[56] References Cited

U.S. PATENT DOCUMENTS 3,830,412 8/1974 Green ..... 222/402.24
3,854,636 12/1974 Conway et al. ..... 222/402.24
3,958,727 5/1976 Steiman ..... 222/402.24
4,078,705 3/1978 Butcher ..... 222/402.24
4,133,461 1/1979 Vercelot ..... 222/402.24
5,083,685 1/1992 Amemiya et al. ..... 222/402.24 X
5,326,002 7/1994 Dubini ..... 222/402.24 X

*Primary Examiner*—Andres Kashnikow
*Assistant Examiner*—Kenneth Bomberg
*Attorney, Agent, or Firm*—Dallett Hoopes

[57] ABSTRACT

An aerosol valve used in a dispenser containing a water-/alcohol system in which the valve body and valve stem are molded from a highly nucleated polypropylene.

3 Claims, 1 Drawing Sheet

AEROSOL VALVE

BACKGROUND OF THE INVENTION

1. Field of the Invention

This invention relates to aerosol valves used in aerosol dispensers containing water/alcohol systems. More specifically, the invention relates to such aerosol valves having plastic parts of a plastic which is not degraded over time in use with such water/alcohol systems.

2. Description of Related Art

FIG. 1 shows an aerosol valve in centerline section. The valve shown is of the type commonly used in dispensing deodorants, hair spray, bug sprays and so forth. It comprises a valve body 12 which is crimped into the pedestal of a mounting cup 14 of a metal container (shown only partially). Disposed between the valve body 12 and the top of the mounting cup pedestal is a gasket 18 having its opening aligned with a hole in the top of the pedestal. A valve stem 20 is provided and comprises a tubular upper part 21 which extends through the gasket and has a lower head section 22 which normally is driven by a spring 23 to seat on the gasket 18 closing off the port 24 through the tubular part 21. The lower end of the valve body 12 is formed with a tailpiece 26 which is connected to a dip tube 28 extending down into the liquid in the container.

An actuator button 28 fits snugly on the top of the upper part 21 of the stem as shown. It is provided with an orifice 30 through which the product is dispensed. It may include a swirl chamber as is conventional.

In the prior art the valve body 12 and stem 20 have almost invariably been made of Nylon 6/6, a material which molds well and has stood up to the propellant/-products system heretofore used. It has been the practice to add to the Nylon material a mold lubricant such as a stearate to facilitate the molding process.

With the new demands of the government agencies which require reduced use of volatile organic compounds (V.O.C.'s), the aerosol industry has had to turn its attention to the amount of alcohol (which is the product in a hair spray, for instance) and the propellant (a hydrocarbon). To reduce the percentage of this mix, the aerosol filler has had to add water to bring V.O.C.'s down to an acceptable level. This substitution has provided a satisfactory aerosol dispensing system for the most part, but there have been problems. Contrary to the experience with systems without water added, the industry has noted that with water/alcohol systems there has been a tendency for the port 24 in the stem or the orifice 30 in the button to occasionally clog with solids heretofore of unknown origin.

To attempt to ascertain the cause of the clogging, I took Nylon samples in the form of Nylon pellets and Nylon valve bodies and systematically soaked such samples in a jar containing a water/ethanol mixture. After a period of time, I removed the pellets and bodies and permitted the remaining liquid to evaporate in a petri dish. Surprisingly, I discovered a residue containing solid particles. From this I have concluded that the Nylon, over a period of time in the water/alcohol system, partly disintegrates. This discovery has, of course, led to the postulate that the clogging of the orifice in the actuator button in aerosol systems using a water/alcohol system has been caused by the disintegration of the Nylon.

In an effort to confirm correctness of the postulate and to specify an alternate plastic suitable for molding aerosol valve parts which would be moldable in production and not be susceptible to the aforesaid disintegration and breaking away of plastic crystals and tiny fragments, we have conducted experiments as described above on samples of various available plastic substitutes, soaking the samples in the water/alcohol system, removing the samples and noting the residue after evaporation of the liquid.

SUMMARY OF THE INVENTION

After the work described above, we have concluded that the disintegration or fragmenting of the plastic parts of an aerosol valve has caused the problem of clogging and can be avoided by selecting a highly nucleated polypropylene with which to mold the valve parts.

The invention, therefore, is an aerosol valve having a valve body molded from a highly nucleated polypropylene. The valve stem may be molded from the same material.

DESCRIPTION OF THE PREFERRED EMBODIMENT

Figure 1:
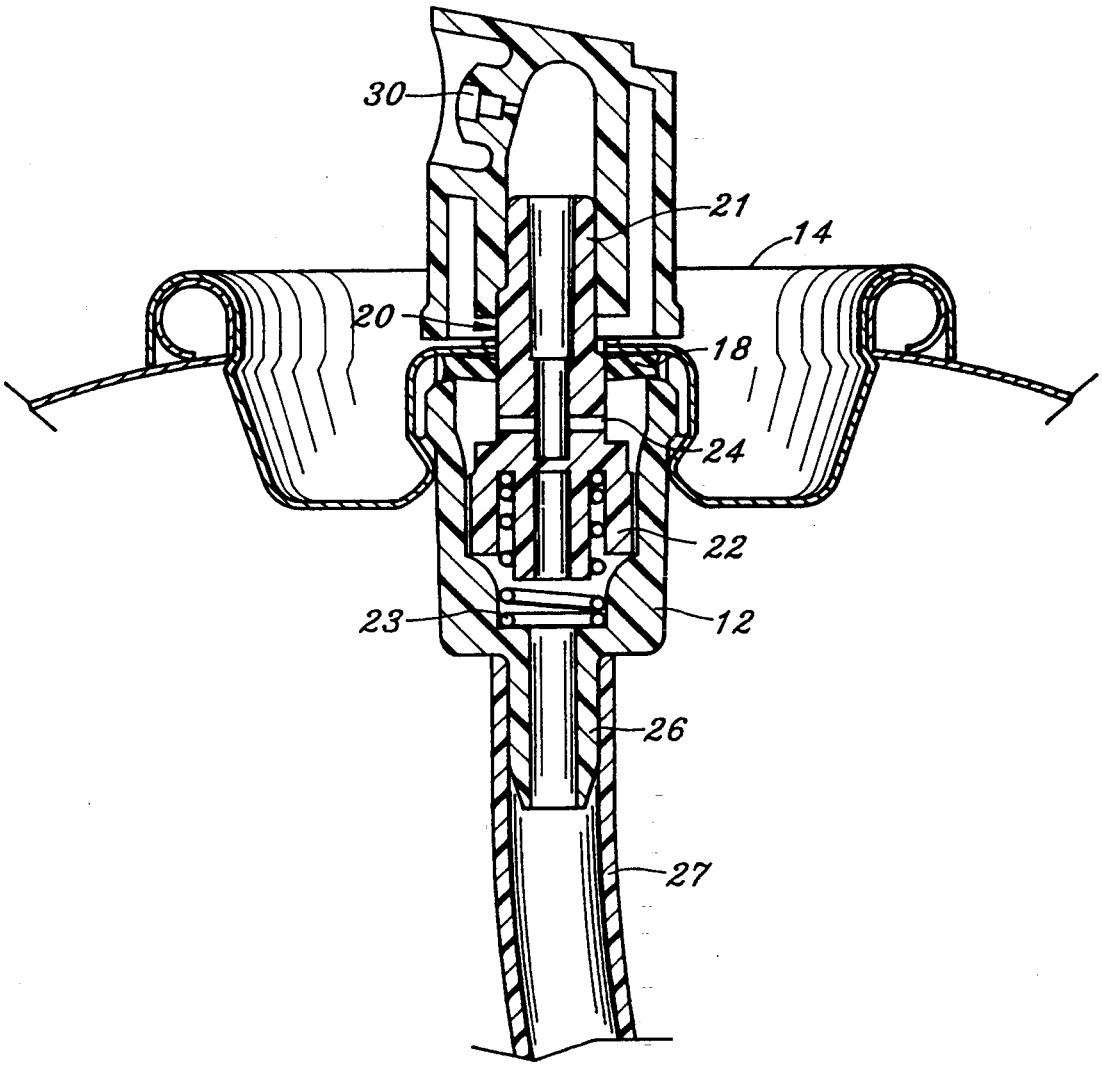
FIG. 1 is a sectional view of a preferred embodiment of the aerosol dispenser incorporating the improved highly nucleated polypropylene homopolymer valve of the invention.

In the preferred embodiment the plastic with which the valve body and stem are molded from, a highly nucleated polypropylene available under the trademark "AMOCO" further designated "ACCPIO" Homopolymer Resin Grade 9433 available from the Amoco Chemical Co. This product has the following properties:

| Typical Resin Properties | Value | ASTM Method |
|---|---|---|
| Melt flow rate g/10 min | 12.0 | D1238 |
| Density g/cm$^3$ | 0.910 | D1505 |
| Tensile strength, psi | 6130 | D638 |
| Flexural Modulus. 10$^3$ psi | 350 | D790 |
| Rockwell hardness. R scale | 109 | D765 |
| Deflection temperature, at 66 psi. °F. (°C.) | 270 (132) | D646 |
| Izod impact strength, notched, ft-lb/in | 0.4 | D256 |
| Elongation at break, % | 10 | D638 |

Valves having parts molded of the above material have not exhibited any clogging of the stem port or, for that matter, orifice of the actuator button. At the same time, the selected plastic is moldable in production.

It should be understood that while a single embodiment is disclosed, the invention is not limited, but may be thought of as having a scope as set forth in the following claim language.

What is claimed is:

1. In an aerosol system comprising:

a. a container having a mouth and containing a water-/alcohol mixture including a product and a propellant under pressure, b. an aerosol valve assembly comprising (1) a mounting cup crimped into the mouth of the container and having a central opening, (2) a cup-shaped valve body installed against the underside of the mounting cup facing upward, (3) an annular resilient gasket sealingly disposed in the open end of the valve body against the underside of the mounting cup, (4) a valve stem in the valve body comprising a tubular element snugly disposed in the gasket and having a lateral opening therein normally closed by the gasket and an enlarged valving head unitary with the lower end of the tubular element and normally seated against the underside of the gasket, the tubular element extending up through the central opening in the mounting cup, (5) spring means compressively disposed between the valve stem and the valve body urging the valve stem toward the gasket with the enlargement against the underside of the gasket, (6) a dispensing head on the upper end of the valve stem and having a discharge passage therein and an outlet orifice connected thereto, (7) dip tube means operatively connected to the valve body so that the dip tube, the valve body, the lateral opening in the valve stem, the tubular element and the dispensing head and orifice constitute a flow path for the product through the valve, the improvement in which the cup-shaped valve body is composed of a plastic compound which is a highly nucleated polypropylene homopolymer resin having the following characteristics:

| PROPERTIES: | VALUE: | ASTM METHOD: |
|---|---|---|
| Melt flow rate g/10 min | 12.0 | D1238 |
| Density g/cm$^3$ | 0,910 | D1505 |
| Tensile strength, psi | 6130 | D638 |
| Flexural Modulus. 10$^3$ psi | 350 | D790 |
| Rockwell hardness. R scale | 109 | D785 |
| Deflection temperature, at 66 psi. °F.(°C.) | 270 (132) | D648 |
| Izod impact strength, notched, ft-lb/in | 0.4 | D256 |
| Elongation at break, % | 10 | D638 |

and which is not crystallized or otherwise disintegrated by being exposed to the water/alcohol mixture.

2. An aerosol system as claimed in claim 1 wherein the valve stem is also composed of the said plastic compound.

3. An aerosol system in which the alcohol is ethanol.

* * * * *